United States Patent [19]

Roche et al.

[11] Patent Number: 4,971,148

[45] Date of Patent: Nov. 20, 1990

[54] FLOW DIVERTER

[75] Inventors: Joseph R. Roche; Hugh L. Elkins, both of Kingwood, Tex.

[73] Assignee: Hydril Company, Houston, Tex.

[21] Appl. No.: 303,905

[22] Filed: Jan. 30, 1989

[51] Int. Cl.[5] ..... E21B 33/04

[52] U.S. Cl. ..... 166/88; 166/82; 277/34.3

[58] Field of Search ..... 166/88, 84, 82, 80, 166/86, 95, 97; 175/195, 214; 251/1.1, 1.2; 285/362; 277/34.3, 34.6, 31

[56] References Cited

U.S. PATENT DOCUMENTS

| | | | |
|---|---|---|---|
| Re. 20,631 | 1/1938 | MacClatohie | 166/88 X |
| 1,889,787 | 12/1932 | Minor | 166/88 |
| 2,475,429 | 7/1949 | Humason | 166/88 X |
| 2,504,025 | 4/1950 | Humason | 166/88 X |
| 3,337,222 | 8/1967 | Smith et al. | 277/34.3 |
| 3,583,480 | 6/1971 | Regan | 166/5 |
| 3,614,111 | 10/1971 | Regan | 277/3 |
| 3,737,139 | 6/1973 | Watts | 251/1.2 |
| 3,791,442 | 2/1974 | Watkins | 166/5 |
| 3,897,071 | 7/1975 | Le Rouax | 251/1.2 X |
| 4,071,085 | 1/1978 | Grable et al. | 166/88 X |
| 4,326,584 | 4/1982 | Watkins | 166/82 |
| 4,345,735 | 8/1982 | Regan | 251/1 B |
| 4,358,085 | 11/1982 | Wegan et al. | 251/1 B |
| 4,428,433 | 1/1984 | Watkins | 166/339 |
| 4,456,063 | 6/1984 | Roche | 166/84 |
| 4,602,794 | 7/1986 | Sehaeper et al. | 251/1.2 X |
| 4,640,372 | 2/1987 | Davis | 166/82 X |
| 4,754,820 | 7/1988 | Watts et al. | 175/195 |

OTHER PUBLICATIONS

Composite Catalog of Oilfield Tools and Equipment, 1970–71, pp. 4166, 4167; 1974–75, pp. 4262, 4263; 1980–81, pp. 6280, 6281; 1986–87, pp. 3000, 3001, 3002, 3003, 3004.

Catalog, Hughes Offshore, KEDJ Platform Diverter System, 1983.

*Primary Examiner*—Hoang C. Dang

*Attorney, Agent, or Firm*—Vaden, Eickenroht, Thompson & Boulware

[57] ABSTRACT

There are disclosed several embodiments of a flow diverter each of which includes a housing installed beneath the floor of a drilling rig on the upper end of a conductor pipe through which a well is to be drilled, a thrust plate sealably supported within a bore through the housing above a side outlet in the housing through which well fluid may be diverted, and a sealing element carried within the bore of the thrust plate for sealably engaging about a pipe string extending into the conductor pipe.

18 Claims, 4 Drawing Sheets

Figures 1A, 1B:
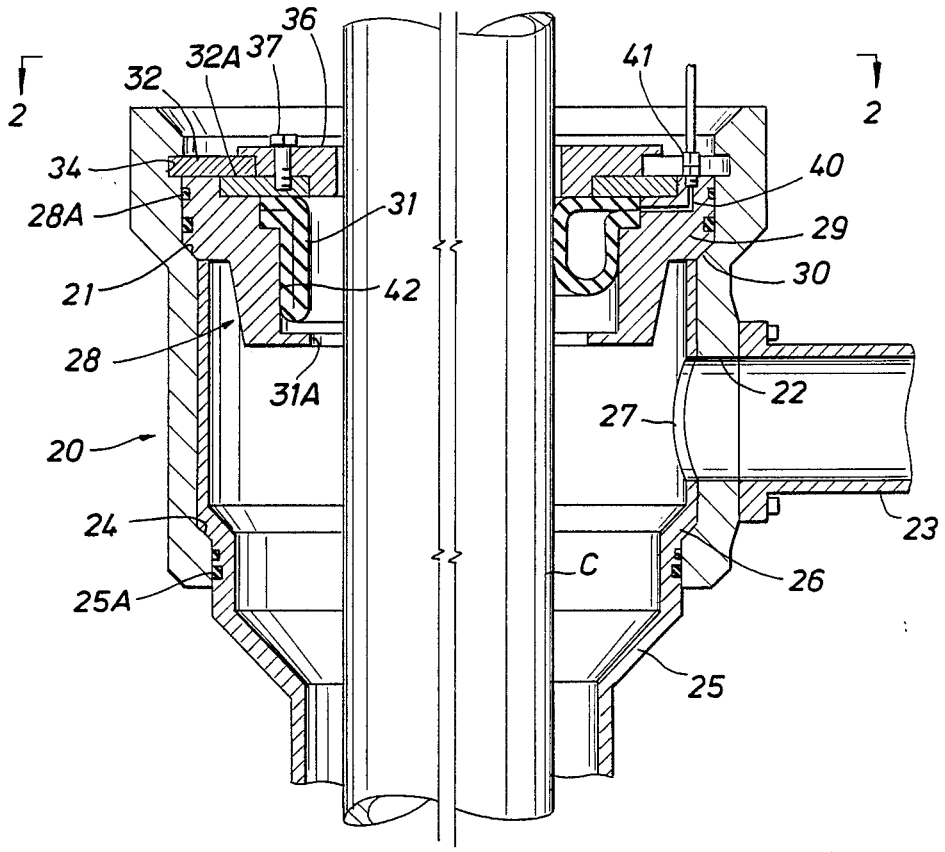

FIG. 3A
FIG. 3B
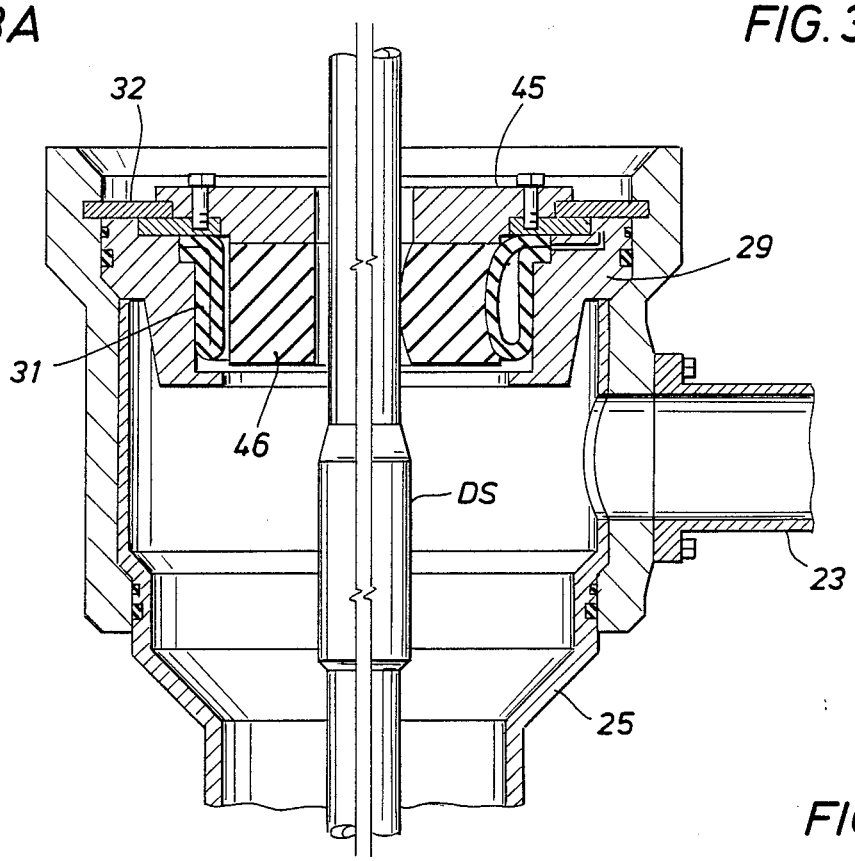
FIG. 4
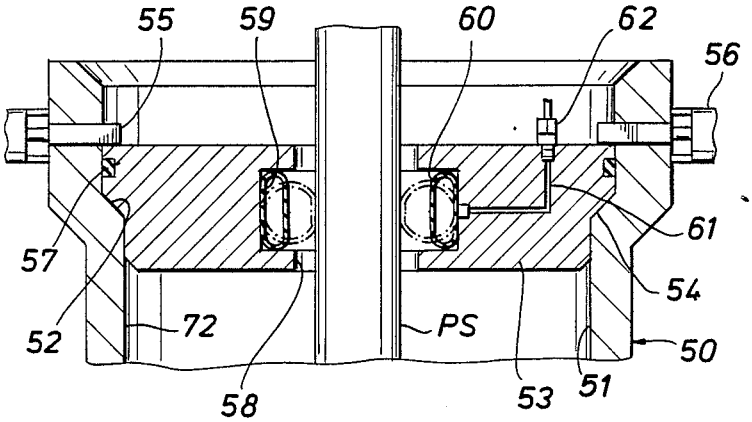
FIG. 5
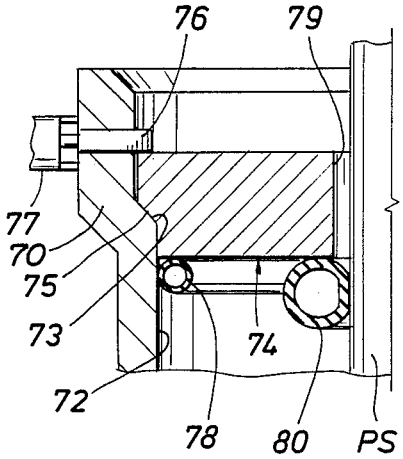
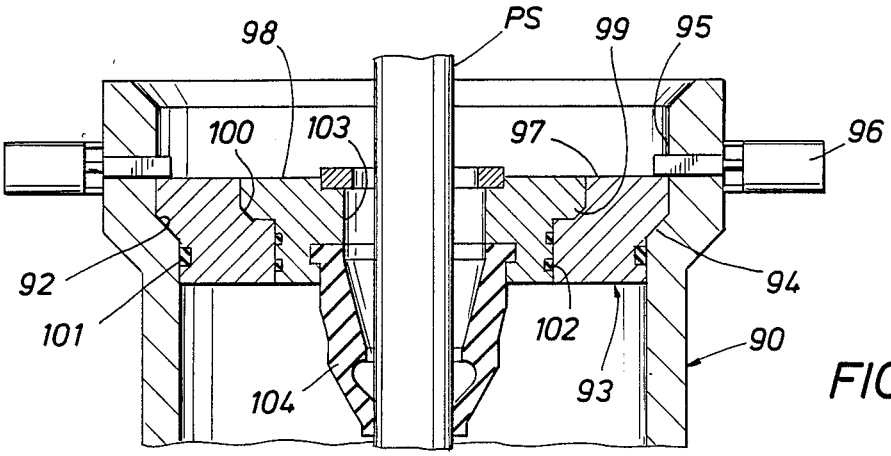
FIG. 6

FIG. 7A
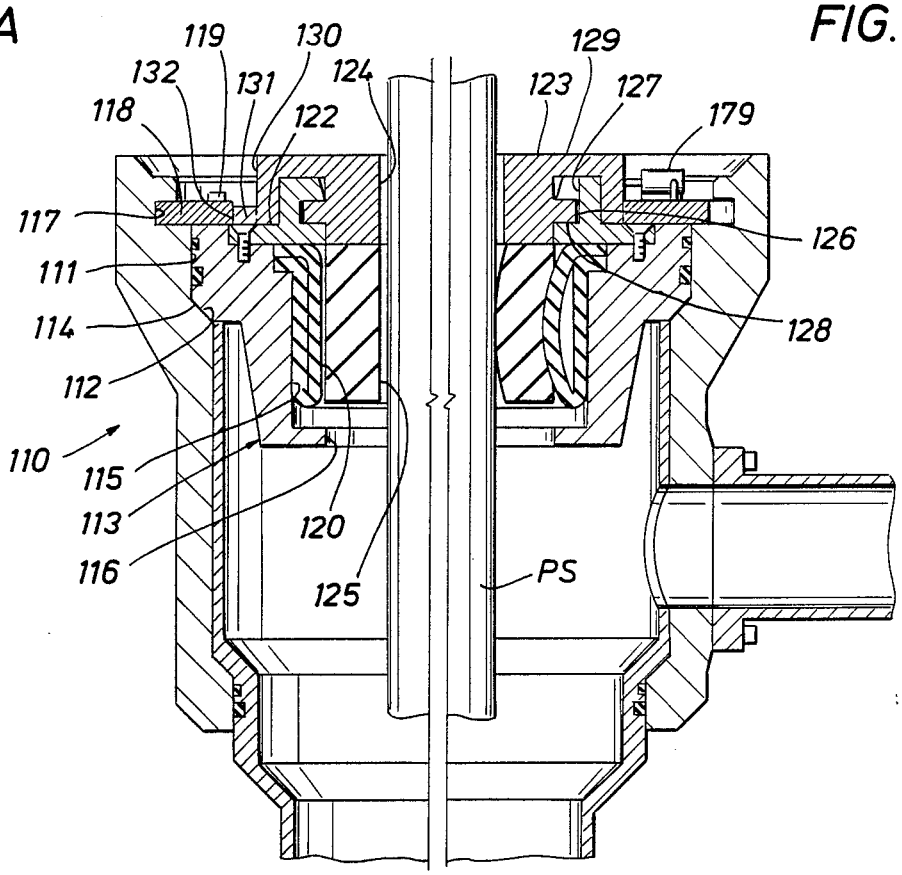
FIG. 7B
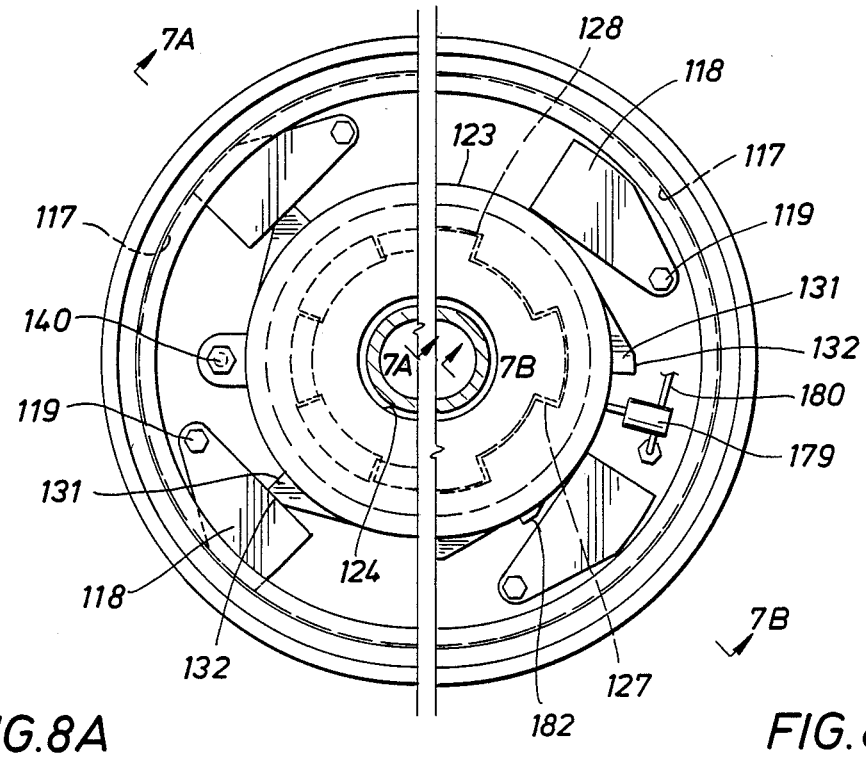
FIG. 8A
FIG. 8B

FIG. 9A
FIG. 9B
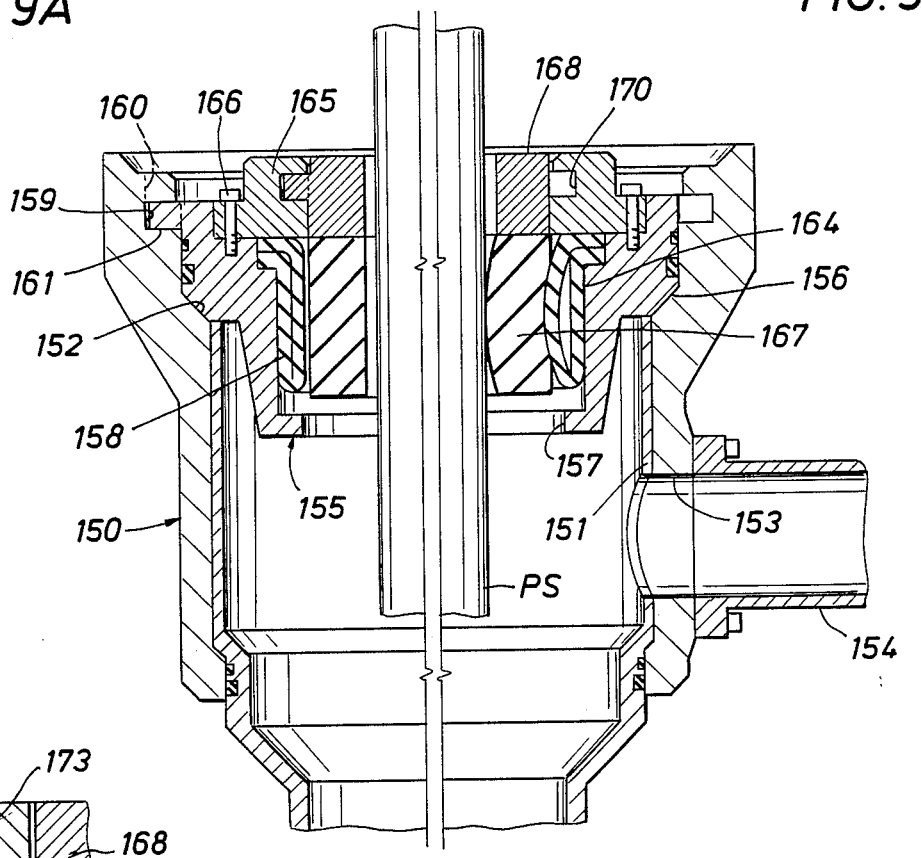
FIG.11
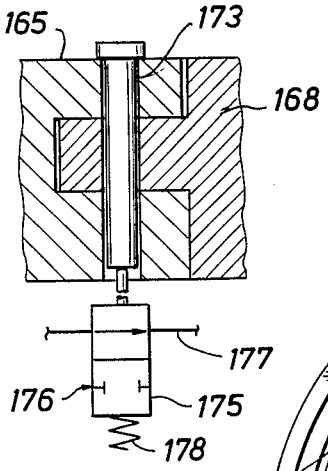
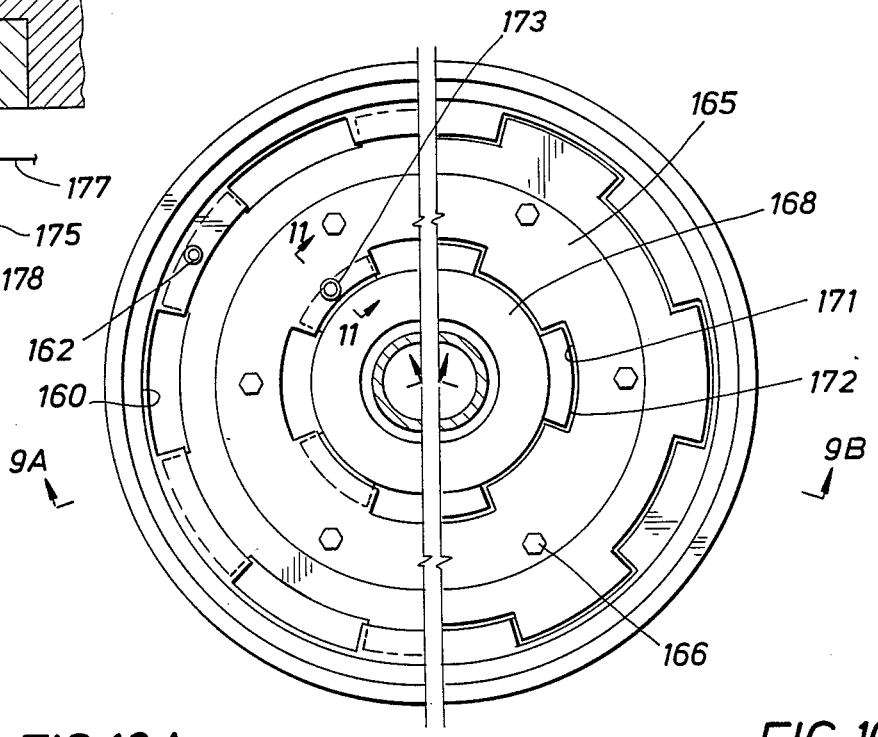
FIG.10A
FIG.10B

FLOW DIVERTER

This invention relates generally to improved apparatus for use in diverting the flow of well fluid away from a drilling rig during the drilling of a well through a conductor pipe.

Apparatus of this type, known in the art as a "flow diverter", includes a housing which is installed beneath the rig floor on the upper end of the conductor pipe, as, for example, a marine riser in the case of an offshore well, and a body which is adapted to be lowered through the open upper end of the housing and landed on a shoulder in sealed engagement with the housing. A sealing element in the form of an annular body of elastomeric material is carried by the body within a bore therethrough for sealably engaging about a pipe string extending into the conductor in order to divert flow beneath the sealing element through a side outlet in the housing. The pipe string may be large diameter casing or a relatively small diameter drill string.

The need for diverting flow occurs when gas encountered at shallow depths is at such volume and pressure as to endanger personnel and/or equipment in and around the rig floor. At this stage of drilling, the outer casing is unable to withstand high pressures, and hence no effort is made to contain the well fluid, as in the case of a blowout, but merely divert it to a safe location.

The flow diverter forms part of an overall system which includes suitable valves in flowline leading from its side outlet for first venting into the flowline and then closing its connection to a shale shaker at the rig floor when the need for diverting flow first occurs. The operator of the system must be assured that the body and sealing element are locked down in the housing to prevent them from being blown out by the pressure of the well fluid. This requirement for verification is of course subject to human as well as mechanical error.

In a prior diverter of this general type, the sealing element includes a so-called "packer insert" which is adapted to be installed within an outer annulus of elastomeric material carried with the bore of the body within the housing, and which, upon constriction, causes the packer to sealably engage about the pipe string. This packer insert as well as the above-mentioned body are locked down by hydraulically actuated latches which cannot normally be seen from above the open upper end of the housing. Hence, unless malfunction or jamming of the hydraulic actuators is otherwise detected by the verification system, the body and/or insert may be blown out.

An object of this invention is to provide a diverter of this general type which is of such construction as to require less verification and/or manipulation during use than that above described.

Another object is to provide such a diverter housing or inner body and/or sealing element which is easier to install.

Another object is to provide a diverter having a less complex hydraulic operating system.

Another object is to provide a diverter which is functionally simpler and structurally stronger.

These and other objects are accomplished, in accordance with one or more embodiments of the present invention, by a diverter of this general type in which the inner body is a diverter plate adapted to be supported on a shoulder in the housing beneath its open upper end and having a hole therethrough which is large enough to receive a pipe string therethrough, but small enough to be supported by the bottom hole assembly of the drill string as it is lowered onto the shoulder, thus eliminating the need for running it on a special tool. The plate carries seal means thereabout for sealing with respect to the housing, when so supported, and is adapted to be releasably locked down on the shoulder by means which is visually observable from above the open upper end of the housing, thus eliminating the need for otherwise verifying that it is so locked down.

In accordance with certain embodiments of the invention, the plate is adapted to be held down by latching elements mounted on the plate for movement between latching and unlatching positions with respect to a groove about the bore of the housing adjacent the top of the supported plate. More particularly, a wear bushing adapted to be releasably held down on the thrust plate has a hole therethrough aligned with the hole in the thrust plate and is of such construction that, when supported and held down, it prevents movement of the latching elements to unlatching position. Thus, the operator may verify that the plate is locked down only if he is able to install the bushing. In a preferred embodiment, the wear bushing is adapted to be held down by a breech lock connection to the thrust plate, and has parts thereon which engage the latching elements to move them to latching position as the bushing is rotated to make up the connection.

In accordance with one embodiment of this invention, the packing element comprises a hollow ring of elastomeric material which is preinflated so as to sealably engage about different pipe diameters without having to be activated, thus eliminating one verification step. In accordance with another embodiment, it comprises a sleeve of elastomeric material having an upper end carried within the bore of the plate and a lower reduced end for sealably engaging about the pipe string, much like a conventional stripper rubber. Alternatively, the seal element is a hollow ring of elastomeric material adapted to be inflated, upon signal, by fluid pressure supplied thereto through suitable means on the thrust plate, for sealing about various pipe diameters.

Preferably, however, the sealing element comprises an annular bag of elastomeric material having its upper open end connected to means within the bore of the plate for inflating it into sealing engagement about casing or other large diameter pipe, and adapted, when deflated, to collapse within a counterbore in the plate. More particularly, the seal assembly includes an insert packer which is disposable within the bag so as to be compressed into sealable engagement with drill pipe or other small diameter casing when the bag is inflated.

In a preferred embodiment, the insert packer is adapted to be suspended from a wear bushing which is landable within the upper end of the bore of the thrust plate, and adapted to be locked down in supported position on the wear plate so as to prevent the packer element from being blown out under pressure. Preferrably, the upper end of the packer element is molded or otherwise secured to the wear bushing, and has a lower end which is not reinforced by metal which might erode more due to the abrasive well fluid.

In accordance with a preferred embodiment of the invention, the wear bushing is held in its rotated position by one or more pins adapted to be received within aligned holes in the wear bushing and the thrust plate. The upper ends of the pin or pins provide a visual indication through the upper end of the housing that the wear bushing is in fact in locked position, inasmuch as the pin will be received in the holes only in the event that the wear bushing is in fact in locked position. More particularly, a means is preferrably provided for admitting fluid pressure to the bag so as to activate the insert packer only in the event that the wear bushing is in fact in locked position.

In the preferred embodiments of the invention, there is a second shoulder provided about the bore of the housing beneath the side outlet, and a spool is adapted to be landed on the shoulder and to extend through the open lower end of the housing for connection with a riser pipe. More particularly, the spool has a hole therethrough adapted to be aligned with the side outlet in the housing, and has an upper end which extends to the bottom of the thrust plate so that the upward thrust on the riser and thus the spool is taken by the thrust plate through its latched connection to the housing. Because of this construction, the seal element carried by the thrust plate may be replaced without disturbing the support of the riser pipe in that the pipe continues to be held down as the seal element is replaced.

Figure 2:
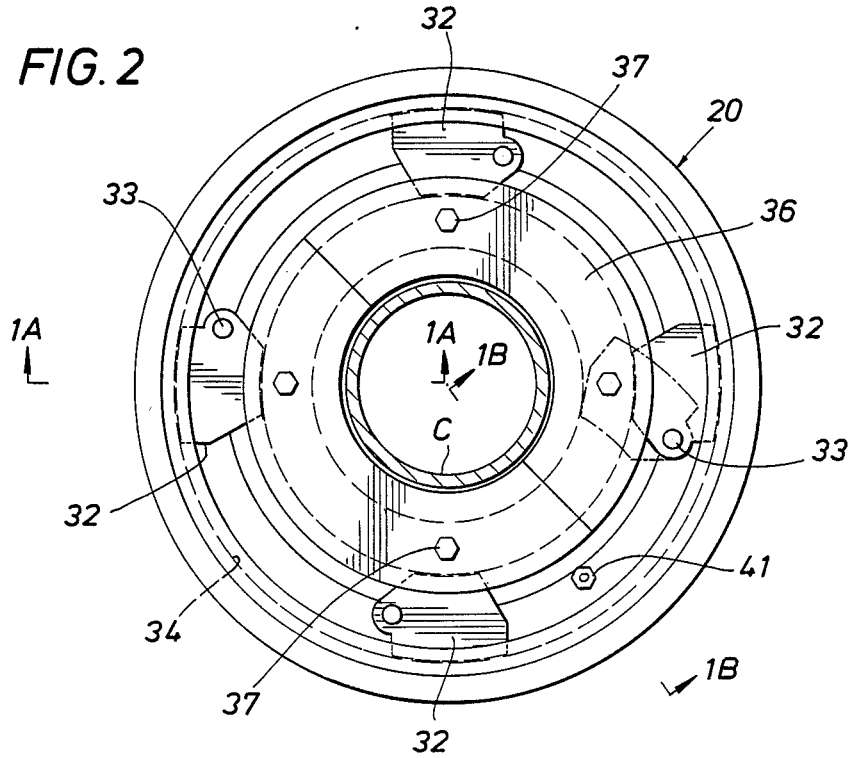

In the drawings, wherein like reference characters are used throughout to indicate like parts:

FIGS. 1A and 1B are half vertical sectional views of apparatus constructed in accordance with one embodiment of the present invention, including an inflatable annular bag of elastomeric material carried by the thrust plate thereof, the bag being shown in FIG. 1A in its deflated position wherein it is folded downwardly into a counterbore within the thrust plate, and in FIG. 1B upon inflation into sealing engagement with a casing string extending downwardly through the thrust plate;

FIG. 2 is a top plan view of the apparatus of FIG. 1, showing latching elements mounted on top of the thrust plate for movement between solid line positions in which their outer edges are disposed within a groove about the housing bore in order to hold the thrust plate down on a shoulder within the housing, and in broken lines in their unlatching positions to which they may be moved, upon raising of the wear bushing, in order to permit the thrust plate to be moved into or out of its supported position within the housing;

FIGS. 3A and 3B half vertical sectional views of the apparatus of FIGS. 1A and 1B but in which the wear bushing has been replaced by another wear bushing from which an insert packer is suspended for disposal within the bag, the bag being deflated in the position of FIG. 3A but being shown in partially inflated position in FIG. 3B so as to close about the outer diameter of the packer insert, and thus cause the bore of the insert to sealably engage about the drill string;

FIGS. 4 is a vertical sectional view of apparatus constructed in accordance with another embodiment of the invention, wherein the thrust plate is releasably held down by means of hydraulically operated latches carried about the housing, and having a sealing element in the form of a hollow ring of elastomeric material carried within a recess in the bore of the thrust plate, the ring being shown deflated in solid lines and in broken lines in an inflated position in which its inner diameter sealably engages about a pipe string extending through the thrust plate;

FIG. 5 is a half vertical sectional view of apparatus constructed in accordance with a further embodiment of the present invention, including a thrust plate releasably held down on a shoulder in the housing by means of hydraulically actuated latches, as in the apparatus of FIG. 4, but wherein the sealing element comprises a preinflated hollow ring of elastomeric material carried by the thrust plate for sealably engaging about a pipe string extending through the thrust plate;

FIG. 6 is a vertical sectional view of apparatus constructed in accordance with yet another embodiment of the present invention, wherein the thrust plate comprises an outer body supported on a shoulder within the housing and held down by means of hydraulically actuated latches, as in the case of the previously described embodiments, and further including an inner body carried within and sealed with respect to the outer body and carrying an elongate sealing element of elastomeric material having a restricted lower end sealably engaged with a pipe string extending through the inner body;

FIGS. 7A and 7B are half vertical sectional views of apparatus constructed in accordance with a still further embodiment of the present invention, and as seen along broken lines 7A—7A and 7B—7B, respectively, of FIGS. 8A and 8B, wherein the thrust plate is adapted to be releasably held down on a shoulder within the housing by means of latching elements which are forced into latched position in response to connection of a wear bushing to a plate, FIG. 7A showing a bag suspended from the bushing in deflated position, and FIG. 7B showing the bag partially inflated to force the bore of the packer insert into sealing engagement about a pipe string extending therethrough;

FIGS. 8A and 8B are partial plan views of the apparatus of FIGS. 7A and 7B, FIG. 8A showing the wear bushing rotated to a position in which it is releasably connected to the thrust plate and in which cam surfaces thereon have forced latching elements into latching position within a groove about the bore of the housing, and FIG. 8B showing the bushing rotated to another position in which it may be moved into or out of connection with the thrust plate and in which the cam surfaces permit the latching elements to be moved out of latching position, thereby permitting the thrust plate to be raised or lowered from the housing;

FIGS. 9A and 9B are half sectional views of apparatus constructed in accordance with still another embodiment of the present invention, wherein the thrust plate is releasably held down on a shoulder within the housing by a breech block connection to the housing, and wherein a wear bushing from which a packer insert is suspended is releasably connected to the thrust plate by means of another breech block connection, the sealing element comprising an annular bag which is shown in FIG. 9A in collapsed position and in FIG. 9B in a partially inflated position to force the bore through a packer insert suspended from the wear bushing into sealing engagement with a pipe string extending therethrough;

FIGS. 10A and 10B are partial plan views of the apparatus of FIGS. 9A and 9B, keys on the outer periphery of the thrust plate and wear bushing, respectively, disposed beneath the upper sides of grooves formed in the housing and thrust ring, respectively, so as to hold the thrust ring and wear bushing down upon the housing and thrust plate, and further showing pins moved into positions holding the thrust plate and wear bushing against rotation out of their locked positions; and FIG. 11 is an enlarged cross-sectional view of a locking pin of the apparatus, as seen along broken lines 11—11, and a diagrammatic view of a system including a valve adapted to be actuated by installation of the locking pin for permitting pressure fluid to be admitted to the bag of the above described apparatus only when the wear bushing is in locked position.

With reference now to the details of the above described drawings, the embodiment of the apparatus shown in FIGS. 1A, 1B, 2, 3A and 3B comprises a housing 20 which, as previously described, is adapted to be installed on the upper end of a conductor pipe beneath the floor of a drilling rig from which a well may be drilled through the conductor pipe. As shown, the housing is a bell nipple having an open upper end, a shoulder 21 about the bore beneath its lower end, and a side outlet 22 beneath the shoulder. As previously described, a conduit 23 is connected to the side outlet to provide means through which drilling fluid may be returned to the rig floor, during ordinary drilling operations, or alternatively diverted upon activation of the apparatus.

As shown, the housing has another shoulder 24 about its bore above its open lower end, and a tubular spool 25 extends through the open lower end of the bore and is supported on the shoulder 24 beneath outlet 22 by means of a shoulder 26 about the spool. As shown, the spool has a side opening 27, which is aligned with the side outlet when the spool is supported in the housing. The lower end of the spool is adapted to be connected to a marine riser of the like forming the conductor pipe. Seals 25A are carried about the spool for sealing against the bore of the housing beneath shoulder 24.

The apparatus further comprises a thrust plate, indicated in its entirety by reference character 28, and comprising an annular body 29 adapted to fit closely within the upper end of the bore through the housing and having a shoulder 30 for landing upon the shoulder 21 in the bore of the housing above the upper end of the spool when the plate is so supported and seal rings 28A carried thereabout seal with respect to the bore of the housing above shoulder 21. The open lower end of the thrust plate has a hole 31A therethrough of a size which permits a pipe string, such as the casing C, to pass therethrough and into the spool and riser, but small enough to be supported on a bottom hole assembly of a drill string as the later is run into the conductor pipe, whereby the thrust plate may be lowered with the assembly onto the shoulder 21.

The diverter also includes a sealing element in the form of an annular bag 31 of elastomeric material carried within the bore of the thrust plate in a position to sealably engage about the casing, as shown in FIG. 1B. The bag is of U-shape in cross section and has the edges of its open end held tightly between a shoulder, about the bore of the thrust plate and a retainer ring 32A which is connected to the thrust plate in any suitable manner.

The thrust plate is releasably locked down on shoulder 21 in the housing by means of a series of circumferentially spaced apart latching elements 32 comprising plates which are supported on top of the thrust plate for pivotal movement about pins 33 extending therethrough and into the top of the thrust plate. More particularly, the plates are adapted to rotate between unlatching positions, as shown in broken lines, to permit the plate to be lowered into or raised from supported position, and the latching positions shown in solid lines in which their outer edges are received within a groove 34 about the bore of the housing generally opposite the top of the thrust plate when supported in the housing. When moved into the groove, the latching plates hold the thrust plate down upon the shoulder 21 and absorb upward thrust on the plate, as well as upward thrust on the spool 25 whose upper end extends upwardly to the lower side of the thrust plate.

A wear bushing 36 is supported on the seal retainer ring 32A of the thrust plate and is locked down thereagainst by means of bolts 37 extending into the retainer ring. As shown, the wear bushing has an inner diameter through which the casing C is received, and serves its conventional purpose in protecting the sealing element of the diverter unit from damage during lowering of the casing or other pipe string therethrough. As shown in FIG. 2, the bushing is split diametrically to permit it to be installed or removed when the pipe string is within the thrust plate.

In accordance with one novel aspect of the present invention, the wear bushing performs a further function in that, when supported on the thrust plate, it prevents the latching elements from moving to unlatching position and thus provides a visual indication that the latching elements are in fact in latching positions. That is, the outer periphery of the wear bushing is adapted to fit closely within the inner edges of the latching segments as best shown in FIG. 2, only when the latching segments are swung outwardly to latching positions.

The bag is adapted to be inflated by means of fluid under pressure introduced into its interior through one or more passageways 40 formed in the thrust plate to connect at their lower ends with the opening between the edges of the bag, and at its upper end with a quick connect coupling 41 mounted on top of the thrust plate intermediate the latching segments. As shown, the thrust plate has a counter bore 42 above the hole 31A in its lower end into which the bag is adapted to fold or collapse when deflated. When the bag is inflated, however, its inner diameter is expanded inwardly to sealably engage about the casing.

As shown in FIGS. 3A and 3B, wear bushing 36 has been replaced by another wear bushing 45 from which an insert packer 46 of elastomeric material is suspended for disposal within the bag 31. This wear bushing is to be used for diverting well fluid when a drill string is extending downwardly through the conductor as well as through the diverter unit, which may occur following or prior to running of casing C shown in FIGS. 1A, 1B and 2. As shown in FIG. 3A, when the bag is deflated, the inner diameter of the packer insert is spaced from the drill string to permit it to pass freely therethrough. However, when well fluid is to be diverted, the bag is partially inflated, as shown in FIG. 3B, so as to compress the packer insert and thus cause its inner diameter to sealably engage about the drill string DS. When so inflated, the bag is substantially confined within counterbore 42.

In other respects, the wear bushing 45 is identical to that of wear bushing 36 in that it is releasably held down upon the retainer ring of the thrust plate by means of bolts or screws. Furthermore, the outer periphery of the wear bushing is such that it can be installed on the thrust plate only when the latching elements are in latching position.

As shown, and as previously described, the packer insert is molded to or otherwise fixedly secured at its upper end to the lower end of the wear bushing. However, its lower side is not obstructed by metal reinforcements or other parts, which might be eroded in the presence of the well fluid.

The embodiment of the apparatus illustrated in FIG. 4 comprises a housing 50 similar to the housing 20 of the previously described embodiment, including a bore 51 therethrough having a shoulder 52 thereabout beneath the open upper end of the housing, and a thrust plate 53 having a shoulder 54 thereabout adapted to land upon the shoulder 52 of the housing and thus be supported therefrom. The thrust plate is adapted to be held down upon the shoulder in the housing by means of latches 55 connected to hydraulic actuators 56 and arranged in circumferentially spaced apart relation about the bore of the housing. As shown, latches are adapted to be moved inwardly to dispose their inner ends above the top of the thrust plate so as to hold the thrust plate down upon the shoulder 52. Although the latches 55 may be observed from the open upper end of the housing, they do not have the advantage of the latching elements of the previously described apparatus in that they are not moved and held in latching positions mechanically, but instead rely upon a hydraulic system for actuation.

As in the case of the thrust plate in the previously described embodiment of the apparatus, the thrust plate 53 carries sealing means 57 thereabout for sealably engaging the bore of the housing when the thrust plate is supported therein. Also, the thrust plate has a bore 58 through which a pipe string PS may extend. As in the case of the previously described embodiment, the lower end of the bore has a hole of such diameter as to permit the thrust plate to be supported on and lowered with the bottom hole assembly of a drill string.

The bore of the thrust plate has an annular recess 59 thereabout and a hollow ring 60 of elastomeric material is carried by the thrust plate within the recess for sealably engaging about the pipe string PS when inflated from the solid line position shown to the broken line position shown in FIG. 4. As will be appreciated, this type of sealing element permits sealing about pipe strings PS of varying diameters. Fluid under pressure is introduced into or exhausted from the ring 60 through a conduit 61 connecting with the recess and thus the inside of the ring 60 at one end and connecting at its opposite end with a quick connect coupling 62 to which a source of fluid under pressure may be connected.

The embodiment of the apparatus shown in FIG. 5 also includes a housing 70 similar to the housings of the previously described embodiment, including a bore 71 therethrough and a shoulder 73 thereabout below the open upper end of the bore, and a thrust plate 74 having a shoulder 75 thereabout which is adapted to land upon the shoulder 73 in the housing so as to support the thrust plate within the housing with the top of the thrust plate beneath the open upper end of the housing. Thus, the thrust plate may be held down in supported position by means of latches 76 adapted to be reciprocated between latching and unlatching position by hydraulic actuators 77. As in the case of the latches 55, the inner ends of the latches 76 are adapted to be moved over the upper ends of the outer diameter of the thrust plate. Additionally, a hollow seal ring 78 is carried by the lower side of the plate adjacent its periphery so as to sealably engage the bore 72 of the housing beneath the shoulder 73 as the thrust plate is lowered into landed position. As in the case of the thrust plate of FIGS. 4A and 4B, thrust plate 74 has a bore 79 therethrough large enough to receive a pipe string PS therethrough, but small enough to permit a hole through its lower end to be supported by a bottom hole assembly for lowering the thrust plate into the housing.

A preinflated hollow ring 80 of elastomeric material carried on the lower side of thrust plate adjacent its bore is adapted to sealably engage with the pipe string PS which is lowered therethrough. As compared with the seal ring 60 of the apparatus of FIG. 4, the seal ring 80 need not be inflated in order to sealably engage the pipe string, but in its preinflated condition is adapted to engage with pipe strings of varying diameter as they are lowered through the bore of the thrust plate.

The embodiment of the apparatus shown in FIG. 6 also includes a housing 90 similar to that of the housings previously described. Thus, the housing has a bore 91 therethrough and a shoulder 92 thereabout beneath its lower upper end. A thrust plate 93 is adapted to be lowered through the open end of the bore of the housing and has a shoulder 94 thereabout for landing on the shoulder 92 to support the thrust plate therefrom. As in the case of the previously described embodiments, the thrust plate 93 is adapted to be held down in its landed position by means of latches 95 moved into and out of latching position by means of hydraulic actuators 96.

As compared with the thrust plates of the embodiments of FIGS. 4 and 5, the thrust plate 93 is made up of an outer annular body 97 on which the shoulder 100 is formed, and an inner body 98 adapted to fit closely within the outer body and having a shoulder 99 thereon supported on the shoulder 100 in the bore of the outer body to support the inner body from the outer body. The outer body carries a seal ring 101 thereabout for sealably engaging the bore 91 of the housing, and the inner body carries seal ring 102 thereabout for sealably engaging with respect to the outer body.

A bore 103 is formed through the inner body to receive a pipe string PS therethrough, and a sealing element 104 is carried by the inner body for sealably engaging about the pipe string. More particularly, as shown, the sealing element 103 is in the form of a typical "stripper" rubber comprising an elongate body of elastomeric material having its upper end secured within the bore 103 and a restricted lower end including a lip adapted to sealably engage the pipe string PS and other pipe strings substantially similar in diameter.

The embodiment of the apparatus shown in FIGS. 7A, 7B, 8A and 8B is similar to that of other previously described embodiments in that it includes a housing 110 having a bore 111 therethrough and a shoulder 112 about the bore beneath the upper end of the housing. More particularly, it includes a thrust plate 113 similar to that of the thrust plate of the first described embodiment in that it has a shoulder 114 thereabout adapted to land upon the shoulder 112 in the housing so as to support the thrust plate within the housing, as well as a bore 115 therethrough having a hole 116 through its lower end beneath a counter bore portion of the bore, the holes 116 being of a size for receiving a pipe string therethrough, but small enough to permit it to support the lower end of the thrust plate from a bottom hole assembly of a drill string so as to lower the thrust plate into landed position within the housing.

More particularly, the bore of the housing above the seat 112 has a groove 117 thereabout adjacent the upper end of the thrust plate when supported in the housing, and latching elements 118 are supported on the top of the thrust plate for movement between latching positions in which their outer edges are received within the groove 117 and unlatching positions in which their outer edges are out of the groove, as shown on the right hand sides of FIGS. 7B and 8B, such that the thrust plate may be alternately locked down in supported position within the housing or alternately raised and lowered with respect thereto. The latching elements are pivotally mounted on pins 119 which extend through them and into holes in the top of the thrust plate so as to permit the latching elements to swing between their latching and unlatching positions.

Similarly to the first described embodiment, a sealing element in the form of an annular bag 120 of elastomeric material is carried by the thrust plate and has the edges of its open upper end held tightly between a recess at the upper end of the thrust plate and a retainer ring 122 releasably connected to the thrust plate in any suitable fashion. When deflated, the bag 120 folds into a position with a counterbore of the thrust plate.

As in the case of the first described embodiment, a bushing 123 is supported on the upper side of the thrust plate and has a bore 124 therethrough adapted to receive a pipe string PS of relatively small diameter. More particularly, a packer insert 125 of elastomeric material is secured to the lower side of the bushing 124 for suspension therefrom within the bag 120, the inner diameter of the insert forming a downward continuation of the bore 124 through the bushing 123. The bag 120 may be partially inflated so as to constrict the insert 125 and thus cause its inner diameter to sealably engage about the pipe string therein. Fluid pressure may be admitted to or exhausted from the bag in the manner previously described in connection with the first embodiment.

The wear bushing 123 is releasably connected to the retainer ring 122 of the thrust plate by a breech lock connection including a groove 126 formed about the inner diameter of the retaining ring and slots formed in the retainer ring to connect the top thereof with the upper side of the groove at circumferentially spaced locations about the bore of the retainer ring. The bushing 123 has keys 128 of such size as to pass through the slots 127 when vertically opposite therethrough, and of a height to fit closely within the groove 126 upon rotation of the bushing.

The bushing 123 has an upper wall 129 extending above the retainer ring, and an outer wall 130 which extends downwardly from the end of the upper wall on the back side of an upwardly extending portion of the retainer ring. Finally, cams 131 extend outwardly from the wall 130 and over the upper side of the outwardly extending portion of the retainer ring and are contoured to provide cam surfaces 132 along their outer sides which are engagable with the inner edges of the latching elements 118 for camming them outwardly into latching position as the wear bushing is moved into locking position with respect to the retainer ring of the thrust plate. That is, with reference to FIGS. 8A and 8B, it will be understood that when the keys on the wear bushing are first lowered into the slots in the retainer ring of the thrust plate, the cam rings will be spaced in a clockwise direction with respect to the inner edges of the latches so as to permit the latches to be moved inwardly to unlatching positions. Then, however, upon counter clockwise rotation of the wear bushing so as to move its keys beneath the lower sides of the groove 126 formed in the retainer ring, the cams are slidable over the inner edges of the latching segments to move them into latching position.

The wear bushing is held in a position in which it has moved the latching segments into latching position by means of one or more pins 140 extending through holes in ears about the periphery of the wear bushing and having lower ends adapted to be received in holes in the upper side of the retainer ring when the wear bushing has been rotated into locking position with respect to the retainer ring. The pins not only prevent the retrograde rotation of the wear bushing, but also provide a visual indicator through the upper end of the housing that the latching segments have been moved into latching position.

The embodiment of the apparatus shown in FIGS. 9A, 9B, 10A and 10B is similar to those embodiments previously described in that it includes a housing 150 having a bore 151 therethrough and being open at its upper end above a shoulder 152 formed thereabout. Additionally, the housing has a side outlet 153 beneath the shoulder which is adapted to be connected with a flow line 154 extending therefrom.

As in the prior described embodiments, a thrust plate 155 is adapted to be lowered through the lower upper end of the housing and has a shoulder 156 thereabout adapted to land on the shoulder 152 of the housing so as to support the thrust plate therefrom. The thrust plate has a bore therethrough which includes a hole 157 through its lower end of a size to permit a pipe string PS to be passed therethrough, but which is sufficiently small to permit it to be supported on the bottom hole assembly of a drill pipe string as it is lowered into the housing. The bore through the housing also includes a counter bore 158.

The thrust plate is adapted to be releasably held down in supported position on the housing by means of a breech lock type of connection between the thrust plate and housing. Thus, as shown, a groove 159 is formed about the housing between the shoulder 152 and its open upper end, and slots 160 are formed in the housing above the groove to connect the groove with the open upper end of the housing at circumferentially spaced locations thereabout. The thrust plate, on the other hand, has keys which project therefrom in circumferentially spaced apart relation and which are of a radial and circumferential extent as to pass through the slots 156 when circumferentially aligned therewith, as shown in FIG. 9B. Then, upon rotation of the thrust plate, the keys may be moved under the upper sides of the groove intermediate the slots, as shown in FIG. 9A, so as to hold the thrust plate down in supported position upon the housing.

A pin 162 is adapted to be lowered through a hole formed in a portion of the thrust plate overhanging the groove and aligned with recesses formed in adjacent peripherial surfaces of one of the keys and the outer side of the groove. In this way, the thrust plate is held against reverse rotation which might disconnect it from the housing, and an observer from above the open upper end of the housing will see the upper end of the pin in place and thus know that the thrust plate is in fact in its locked position—i.e., the pin will not fall into place except when this occurs.

The thrust plate carries a sealing element which includes, as in certain of the prior described embodiments, an annular bag 164 of elastomeric material having its open upper edges held between a recess about the counterbore 158 of the thrust plate and a retainer ring 165 releasably connected to the thrust plate by means of bolts or screws 166. The bag is adapted to be inflated or deflated by pressure pressure through a passageway connecting the upper end of the bag with a quick connect coupling, as in prior described embodiments. When the bag is deflated, as shown in FIG. 9A, it hangs within the counterbore 158 so as to generally in line with the upward extension of the hole 157 in the lower end of the thrust plate bore.

The sealing element also includes a packer insert 167 of elastomeric material which is suspended from a wear bushing 168 adapted to be supported upon and held down by the retainer ring 165 of the thrust plate. Thus, as in the prior described embodiments, the packer insert is disposed within the collapsed bag 158 and forms a downward continuation of the bore through the wear bushing 168 through which the pipestring PS extends. Upon inflation of the bag, the packer insert is inwardly compressed to cause it to sealably engage about the pipe string.

As shown, the wear bushing and thus the packer insert suspended therefrom are supported upon and releasably held down by the retainer ring 165 by a breech lock connection similar to that which connects the thrust plate to the housing. Thus, the bore through the retainer ring has a groove 170 formed thereabout and slots 171 which connect the top of the retainer ring with the upper side of the groove, and the bushing has keys 172 spaced circumferentially thereabout for passing through the stabs into supported positions on the lower side of the groove. The bushing is then rotated to move the keys beneath the upper sides of the groove, and, when the keys are so disposed, the wear bushing is held in locked position by a pin 173 adapted to pass through a hole in the top of the retainer ring and to extend into semicircular recessed portions of one of the keys and groove which form a hole aligned with the hole in the retainer ring when the keys are in locked position. In addition to preventing rotation of the wear bushing out of its locked position, the pin provides a visual indication through the open upper end of the housing that the retainer ring and thus the insert packing are locked down in proper position.

With the wear bushing and packer insert removed, larger pipe, such as casing, may be lowered through the diverter. During this stage of drilling operations, the bag 158 may be partially inflated to sealably engage about the casing, in the event the need arises.

The bag of the apparatus of FIGS. 7A, 7B, 8A and 8B, as well as that of FIGS. 9A, 9B, 10A and 10B, is adapted to be inflated by pressure fluid supplied to its open end through a conduit having a quick connect coupling, as in the apparatus of FIGS. 1 and 2. However, as shown diagramatically in the lower portion of FIG. 11, a valve 175 installed in the conduit 176 intermediate the coupling and bag includes a closure element 177 which is normally urged to closed position by spring 178.

However, when pin 173 of the apparatus of FIGS. 9A, 9B, 10A and 10B is lowered into position to hold bushing 168 in latch locking position, its lower end engages the closure element to move it to open position against the force of the spring and to hold it in that position as long as the pin is in place. Hence, the bag is inflated only when the bushing and thus the insert packer is in locking position and the pin is in holding position, and is maintained inflated until the pin is removed.

In the apparatus of FIGS. 7A, 7B, 8A and 8B, on the other hand, a similar valve 179 is installed in a fluid supply conduit 180 with an extension of the closure element thereof disposed in position to be depressed, and thus moved against the spring, to open position, by a cam 182 about the wear bushing 123 as the wear bushing is moved into locking position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Apparatus for use in diverting the flow of well fluid away from a drilling rig during the drilling of a well through a conductor pipe, comprising a housing adapted to be installed on the upper end of the pipe beneath the floor of the rig, said housing having an open upper end, a shoulder about its bore beneath its upper end, and at least one side outlet beneath its shoulder, a thrust plate adapted to be supported on the shoulder in the housing and having a bore therethrough to receive a pipe string, when so supported, means carried by the thrust plate for sealably engaging the bore of the housing when so supported, and means carried by the thrust plate for sealably engaging about the pipe string so as to divert well fluid into the side outlet, latch means for holding the thrust plate down on the shoulder, comprising a groove about he bore of the housing, and a plurality of latching elements each mounted on top of the thrust plate for moving between positions in which an edge thereof is extended into the groove to hold the plate down and retracted from the groove to permit the plate to be raised from or lowered onto the shoulder, and a wear bushing adapted to be supported by and releasably held down on the thrust plate and having a hole therethrough aligned with the bore in the thrust plate, said bushing being disposed above and said hole therethrough being of no larger diameter than that of the bore of the means for sealably engaging about the pipe string, said bushing, when so supported and held down, preventing movement of the latching elements to unlatched position.

2. Apparatus of the character defined in 1, wherein the latching elements are pivotally mounted on the thrust plate for rotating between latching unlatching positions.

3. Apparatus for use in diverting the flow of well fluid away from a drilling rig during the drilling of a well through a conductor pipe, comprising a housing adapted to be installed on the upper end of the pipe beneath the floor of the rig, said housing having an open upper end, a shoulder about its bore beneath its upper end, and at least one side outlet beneath its shoulder, a thrust plate adapted to be supported on the shoulder in the housing and having a bore therethrough to receive a pipe string, when so supported, means carried by the thrust plate for sealably engaging the bore of the housing when so supported, means carried by the thrust plate for sealably engaging about the pipe string so as to divert well fluid into the side outlet, latch means for holding the thrust plate down on the shoulder, comprising a groove about the bore of the housing, and a plurality of latching elements each mounted on top of the thrust plate for moving between positions in which an edge thereof is extended into the groove to hold the plate down and retracted from the groove to permit the plate to be raised from or lowered onto the shoulder, and a wear bushing adapted to be supported on the thrust plate and having a hole therethrough aligned wit the bore in the thrust plate, when so supported, said bushing being rotatable about the axis of its hole, and having means thereon engagable with means on the latching elements, when so rotated, to move the latching elements into latching position within the groove so as to hold the plate down on the shoulder and means for releasably holding the bushing down on the plate when so rotated.

4. Apparatus of the character defined in 3, including holes in the bushing and plate which are aligned when the bushing has been so rotated, and a pin adapted to be inserted into the aligned holes to hold the bushing in its rotated position, said pin being visible from above the open end of the housing to indicate that the latching elements are in latched position.

5. Apparatus of the character defined in claim 3, wherein the means for holding the bushing down comprises a groove about the bore of the plate and slots in the plate leading to the groove, and keys about the bushing adapted to move vertically through the slots and being movable beneath the upper side of the groove upon rotation of the bushing.

6. Apparatus of the character defined in claim 3, wherein the means for sealably engaging about the pipe comprises an annular bag of elastomeric material carried within the bore of the plate, a packer of elastomeric material suspended from the bushing for disposal within the bag, and means for inflating the bag to close the packer about a pipe string therein.

7. Apparatus for use in diverting the flow of well fluid away from a drilling rig during the drilling of a well through a conductor pipe, comprising a housing adapted to be installed on the upper end of the pipe beneath the floor of the rig, said housing having an open upper end, a shoulder about its bore beneath its upper end, and at least one side outlet beneath its shoulder, a thrust plate adapted to be supported on the shoulder in the housing and having a bore therethrough to receive a pipe string therethrough, when so supported, means carried by the thrust plate for sealably engaging the bore of the housing, when so supported, inflatable means carried by the thrust plate for sealably engaging about the pipe string so as to divert well fluid into the side outlet, means for releasably locking said thrust plate down in supported position on the thrust plate including a groove about the bore of the housing above the shoulder and slots in the housing connecting with the groove, and keys on the thrust plate for moving through the slots, as the plate is lowered into supported position onto the shoulder, said plate being rotatable, when so supported, to move said keys into positions beneath the upper side of the groove so as to releasably lock the plate in supported position on the housing.

8. Apparatus of the character defined in claim 7, including means for releasably holding said thrust plate in its locked position, including means forming aligned holes in the plate and housing when the plate is so rotated, and a pin adapted to be installed within the holes, said pin being visually observable from above the open upper end of the housing when so installed.

9. Apparatus of the character defined in claim 7, wherein the means for sealably engaging about the pipe comprises an annular bag of elastomeric material carried within the bore of the plate, a packer disposable within the bag, and means for inflating the bag to close the packer about a pipe string therein.

10. Apparatus for use in diverting the flow of well fluid away from a drilling rig during the drilling of a well through a conductor pipe, comprising a housing adapted to be installed on the upper end of the pipe beneath the floor of the rig, said housing having an open upper end, and at least one side outlet beneath its shoulder, a body adapted to be supported on the housing and having a bore to receive a pipe string therethrough, when so supported, means for releasably locking the body down on the housing, means for sealing between the body and housing when the body is so supported, and means for sealably engaging about the pipe string so as to divert well fluid into the side outlet, including an annular inflatable element of elastomeric material mounted within the bore of the body, an insert adapted to be supported on the body and including a packer which is disposed within the annular inflatable element, when the insert is so supported, so as to sealably engage about the pipe string upon inflation of the element, means for locking the insert down in supported position on the body, and means for inflating the element only when the insert has been so locked down.

11. Apparatus of the character defined in claim 10, wherein the locking means includes locking parts on the insert movable into locking position with respect to said body, and said inflating means includes means responsive to movement of said locking parts into locking position to admit inflating pressure to said inflatable element.

12. Apparatus of the character defined in claim 11, wherein said inflating means includes a conduit adapted to connect said element with a source of fluid under pressure, and valve means installed in the conduit including a closure member shiftable between positions opening and closing the conduit, spring means urging the closure member to closed position, and means on the closure member which is engaged by the locking parts upon movement to locking position to move the closure member to and maintain it in open position.

13. Apparatus of the character defined in claim 11, wherein the locking means includes locking parts on one of the body and insert movable into locking position with respect to the other of the body and insert, and means movable into positions for holding said locking parts in locking position, and said inflating means includes means responsive to movement of said holding means into holding position to admit inflating pressure to siad inflatable element.

14. Apparatus of the character defined in claim 13, wherein said inflating means includes a conduit adapted to connect said element with a source of fluid under pressure, and valve means installed in the conduit including a closure member shiftable between positions opening and closing the conduit, spring means urging the closure member to closed position, and means on the closure member which is engaged by means on the holding means upon movement to holding position to move the closure member to and maintain it in open position.

15. Apparatus for use in diverting the flow of well fluid away from a drilling rig during the drilling of a well through a conductor pipe, comprising a housing adapted to be installed on the upper end of the pipe beneath the floor of the rig, said housing having an open upper end, a shoulder about its bore beneath its upper end, and at least one side outlet beneath its shoulder, a thrust plate adapted to be supported on the shoulder in the housing and having a bore to receive a pipe string therethrough, when so supported, means for releasably locking the thrust plate down on the shoulder, means sealing between the plate and the bore of the housing when the plate is so supported, p1 means for sealably engaging about the pipe string so as to divert well fluid into the side outlet, including a wear bushing adapted to be supported on the thrust plate, an inflatable element within the bore of the thrust plate, a packer element carried by the wear bushing and disposed within the inflatable element when the wear bushing is so supported, means including fluid from a source of central fluid for inflating the inflatable element so as to compress the packer element about a pipe string, and means releasably holding the wear bushing down on the thrust plate, each of said locking means and holding means being caused to move between their respective locking and holding and released positions by means which is operable independently of said source of control fluid.

16. Apparatus of the character defined in claim 15, wherein the means releasably locking the thrust plate down upon the shoulder in the bore of the housing comprises a groove about the bore of the housing and slots in the housing bore leading to the groove, and keys about the thrust plate adapted to move vertically through the slots and being rotatable to positions beneath the upper side of the groove.

17. Apparatus of the character defined in claim 15, wherein the means holding the bushing down on the thrust plate comprises a groove about the bore of the thrust plate and slots in the thrust plate leading to the groove, and keys about the bushing adapted to move vertically through the slots and being rotatable to positions beneath the upper side of the groove.

18. Apparatus of the character defined in claim 16, wherein the means holding the bushing down on the thrust plate comprises a groove about the bore of the thrust plate and slots in the thrust plate leading to the groove, and keys about the bushing adapted to move vertically through the slots and being rotatable to positions beneath the upper side of the groove.

* * * * *